US006588652B2

(12) United States Patent
Cai

(10) Patent No.: US 6,588,652 B2
(45) Date of Patent: Jul. 8, 2003

(54) FOOD TRAY WITH CONDIMENT COMPARTMENT

(75) Inventor: Liming Cai, West Chester, PA (US)

(73) Assignee: Dopaco, Inc., Exton, PA (US)

( * ) Notice: Subject to any disclaimer, the term of this patent is extended or adjusted under 35 U.S.C. 154(b) by 0 days.

(21) Appl. No.: 10/058,829

(22) Filed: Jan. 30, 2002

(65) Prior Publication Data

US 2002/0108504 A1 Aug. 15, 2002

Related U.S. Application Data

(63) Continuation-in-part of application No. 09/892,653, filed on Jun. 28, 2001.

(60) Provisional application No. 60/265,125, filed on Jan. 31, 2001.

(51) Int. Cl.[7] ..... B65D 5/36; B65D 5/487

(52) U.S. Cl. ..... 229/117.07; 229/120.06; 229/120.12; 229/120.18; 229/160.2; 229/902

(58) Field of Search ..... 229/117.04, 117.07, 229/120.12, 120.18, 120.35, 902, 904, 906, 120.06, 120.29, 120.31, 120.38, 160.2

(56) References Cited

U.S. PATENT DOCUMENTS 2,295,515 A * 9/1942 Hoag ..... 229/117.07
2,794,585 A * 6/1957 Wagner ..... 229/904
4,081,125 A * 3/1978 Meyers ..... 229/120.18
4,089,458 A * 5/1978 Meyers et al. ..... 229/120.06
4,126,261 A 11/1978 Cook
4,955,528 A 9/1990 Schluckebier
5,335,845 A * 8/1994 Liu ..... 229/120.18
5,520,324 A 5/1996 Cai
5,655,707 A * 8/1997 Jensen ..... 229/160.2
5,720,429 A 2/1998 Cordle
5,735,454 A * 4/1998 Jensen ..... 229/160.2
5,842,631 A 12/1998 Berger
6,102,208 A * 8/2000 Huang ..... 229/904
6,119,930 A * 9/2000 Lunstra et al. ..... 229/906
2002/0011514 A1 * 1/2002 Cai et al. ..... 229/120.18

* cited by examiner

*Primary Examiner*—Gary E. Elkins
(74) *Attorney, Agent, or Firm*—Dennison, Schultz & Dougherty

(57) ABSTRACT

A foldable food tray with an integrally formed condiment pocket coextensive with one wall of the tray and defined by a movable partition panel pivotal between a first closed position for foldable collapsing of the pocket with the tray, and a second open position engaged between opposed tray walls to define the pocket and preclude an inward folding of the pocket and tray.

16 Claims, 4 Drawing Sheets

FOOD TRAY WITH CONDIMENT COMPARTMENT

This application claims the benefit of the U.S. Provisional Patent Application No. 60/265,125, filed on Jan. 31, 2001, the contents of which are incorporated herein by reference.

This application is also a continuation-in-part application of U.S. Application Ser. No. 09/892,653, filed Jun. 28, 2001 now pending.

BACKGROUND OF THE INVENTION

One popular manner of serving foodstuffs, particularly in a "fast food" environment, involves the use of open top trays which can easily accommodate french fries, onion rings, chicken nuggets, popcorn shrimp, and like finger foods.

It is often desirable to accompany such foodstuffs with an appropriate condiment which may either be dispensed directly onto the foodstuff within the tray, particularly if consumed immediately, or more likely provided in a separate small container or cup which may be placed within the tray with the foodstuff, if there is sufficient room, or, more likely, carried separately. It has also been proposed to provide food trays which are actually incorporated into the main tray, note for example, U.S. Pat. No. 4,126,261, issued Nov. 21, 1978.

The provision of such food trays with incorporated condiment pockets, while a particularly desirable feature, does give rise to problems. More specifically, fast food containers, to be both practical and economically feasible must be both inexpensive as they are throwaway items and must be extremely easy to manipulate both by the vendor and by the customer.

As a practical matter, the tray, for both shipping and storage purposes, must present a compact package. Pursuant thereto, two basic forms of tray have been used, formed trays which are formed at the time of manufacture into a fully erected position for stacking within compact stacks of duplicate trays. Alternatively, and sometimes preferred, the trays leave the manufacturing process as a flat folded item allowing for a flat overlying packing of multiple folded trays. Both the preformed tray and the folded tray have particular advantages.

SUMMARY OF THE INVENTION

The present invention comprises a foldable tray, that is a tray which at the end of the manufacturing procedure is a flat folded item, which, notwithstanding the folded nature thereof, incorporates an integral condiment compartment or pocket internally within the main compartment of the tray. A significant aspect of the condiment pocket as proposed by the present invention is the additional utilization of the pocket, or more particularly the partition panel which defines the pocket to rigidify the collapsible walls of the tray in the erected position thereof at the time of use. Thus, the erected tray has a stability which closely approaches that of a preformed tray, while incorporating all of the advantages of a flat folded manufactured item.

The folded tray of the invention is what is referred to in carton manufacturing as a straight line glued folding carton. This differs from a formed tray which requires the use of a forming tool that is only adapted for use with a single size product. As the design of the tray of the invention does not need a forming tool in its production, size changes can be easily made in accord with customer desires. Further, it is noted that most packaging companies utilize "straight line gluers" as opposed to "formers". As such, the carton or tray as proposed herein is considered particularly practical.

The tray, folded from a unitary sheet of paperboard or the like, includes a rectangular bottom or bottom panel with opposed side walls and opposed end walls projecting upwardly from the bottom to form an open top container. The walls are end joined by appropriate glue flaps. The opposed side walls include end sections defined by fold lines extending diagonally upward from the corners of the bottom, forming the end sections and a rather wider central section therebetween. In folding the tray, the side walls, and more particularly the central sections thereof, fold inward over the bottom with the side wall end sections first folding outward relative to the corresponding central sections and then inward over the collapsing central sections.

The condiment pocket of the invention includes a partition or partition panel which is coextensive with one of the end walls and foldably joined to the bottom along the base edge of the end wall. A triangular end panel is foldably joined to each end of the partition panel with these ends panels overlying the adjacent end sections of the two side walls. Each of these end panels in turn includes a glue flap foldably joined thereto and adhesively bonded to the corresponding end sections inward of the end section defining fold line. The partition panel, so mounted, will be movable between a collapsed position lying against the end wall and an open position remote from the end wall. In the collapsed position of the partition panel each end panel and corresponding glue flap are coplanar for a collapsible folding of the end panel and glue flap with the corresponding side wall end section inward of the partition panel and end wall. The folding of the carton is completed with the partition panel and end walls folding downward over the side walls to a fully collapsed position.

In the open position of the tray and condiment pocket, the partition panel is flipped inward relative to the end wall with the end panels at the opposite ends of the partition panel inverting to overlie the glue flaps. In this position, the partition panel exerts a stabilizing outward force on the opposed side walls whereby an inward collapsing of the side walls is precluded, and an upwardly opening condiment pocket is defined. With inward movement of the side walls precluded by the transverse partition panel in its open position, a substantial degree of rigidity is introduced into the open tray, notwithstanding the forming of the tray from a flat folded manufactured configuration.

The tray, including the pocket-defining partition, is formed from a single blank with that portion of the blank forming the partition severing from the remainder of the blank only at such time as the tray is completely formed, and preferably as the tray and pocket are opened at the point of use.

Other objects, features and advantages of the invention will become apparent as the details of the invention are more fully hereinafter set forth.

DESCRIPTION OF PREFERRED EMBODIMENTS

Figure 1:
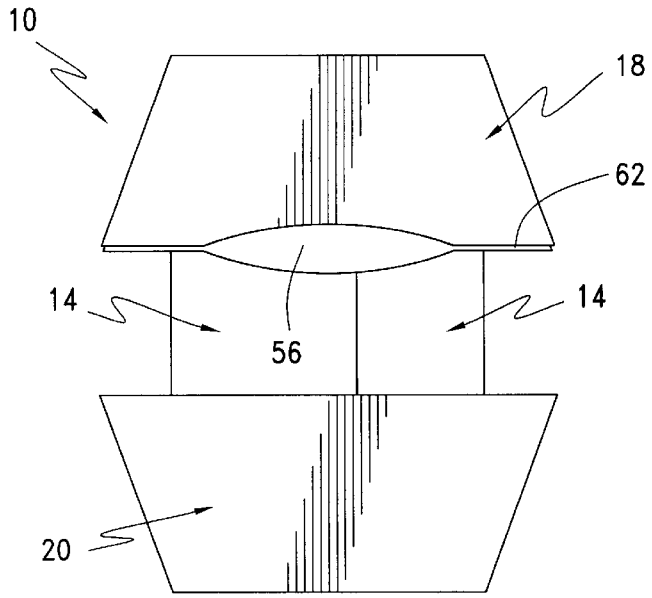
FIG. 1 is a plan view of the food tray folded in its flat shipping and storage position.

Referring now more specifically to the drawings, the tray 10 of the invention basically includes a planar preferably rectangular bottom 12 with opposed side walls 14 coextensive with opposed longitudinal edges 16 of the bottom 12 and upwardly folded therefrom along fold lines defined along these edges.

First and second end walls 18 and 20 are coextensive with end edges 22 and 24 of the bottom 12 and are upwardly folded about fold lines defined along these edges 22 and 24. The side and end walls are joined end to end to define a continuous peripheral wall by glue flaps 26 on the opposite ends of end wall 18 and similar glue flaps 28 on the opposite ends of end wall 24. These glue flaps 26 and 28 overlie the inner faces of the opposed side walls 14 at the end portions thereof and are bonded thereto. As will be noted in the blank of FIG. 6, both the side walls 14 and the end walls 18 and 20 are of a generally trapezoidal configuration widening outward from the side and end edges 16, 22 and 24 of the bottom 12, thereby providing for an outward flaring of the tray walls upward from the bottom 12 thereof.

In order to provide for the desired inward folding of these walls 14, 18 and 20, each of the side walls 14 is provided with a pair of fold lines 30 extending diagonally upward from each of the lower end corners thereof at the corresponding corner of the bottom 12 defined by the bottom side edges 16 and each end edge 22 and 24. The fold lines 30 divide each of the side walls 14 into a generally trapezoidal central section 32 and two smaller inverted triangular end sections 34. As will be noted particularly in FIG. 3, the end walls glue flaps 26 and 28 overlie and are bonded to the end sections 34 of the side walls 14 and thus inwardly fold therewith in a manner which would be best appreciated from FIG. 2. Basically, the center sections 32 of the opposed side walls 14 fold inwardly about the longitudinal edges 16 of the bottom 12 while the triangular side wall end sections 34 inwardly move therewith and outwardly fold to overlie the outer surfaces of the central sections 32 and simultaneously inwardly fold the end walls 18 and 20 to overlie the folded and collapsed side walls 14 as will be noted in FIG. 1.

Figure 3:
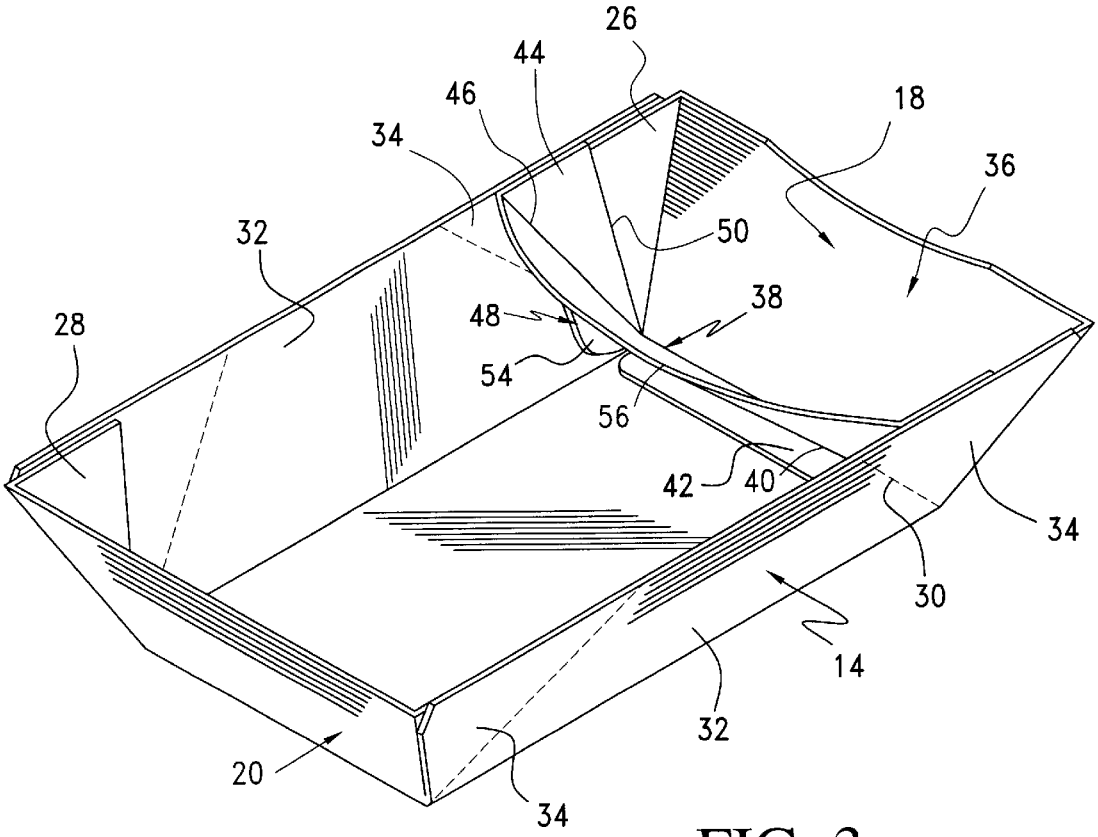
FIG. 3 is a top perspective view similar to FIG. 2 with the condiment pocket open and the pocket forming partition panel extending between and bracing the opposed collapsible side walls.
Figure 5:
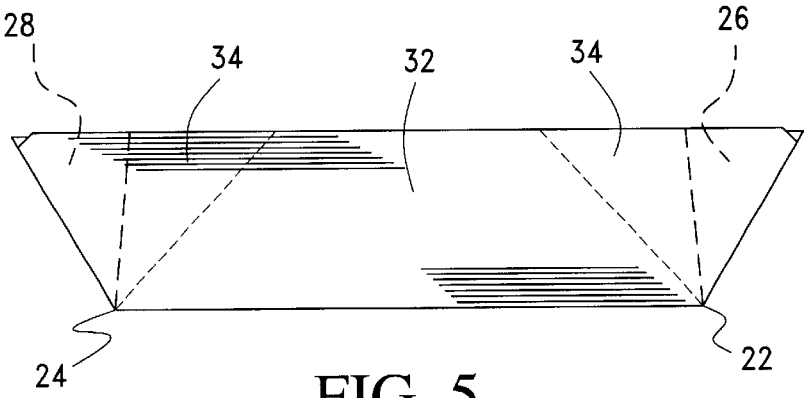
FIG. 5 is a side elevational view of the open tray.

Noting FIG. 3, the foldable tray 10 includes a collapsible condiment pocket 36 formed at one end thereof in conjunction with end wall 18. The pocket 36 is basically defined by a movable partition panel 38 which extends between the end sections 34 of the side walls 32 and is coextensive with end wall 18 across the width thereof and for substantially the full height thereof.

Figure 2:
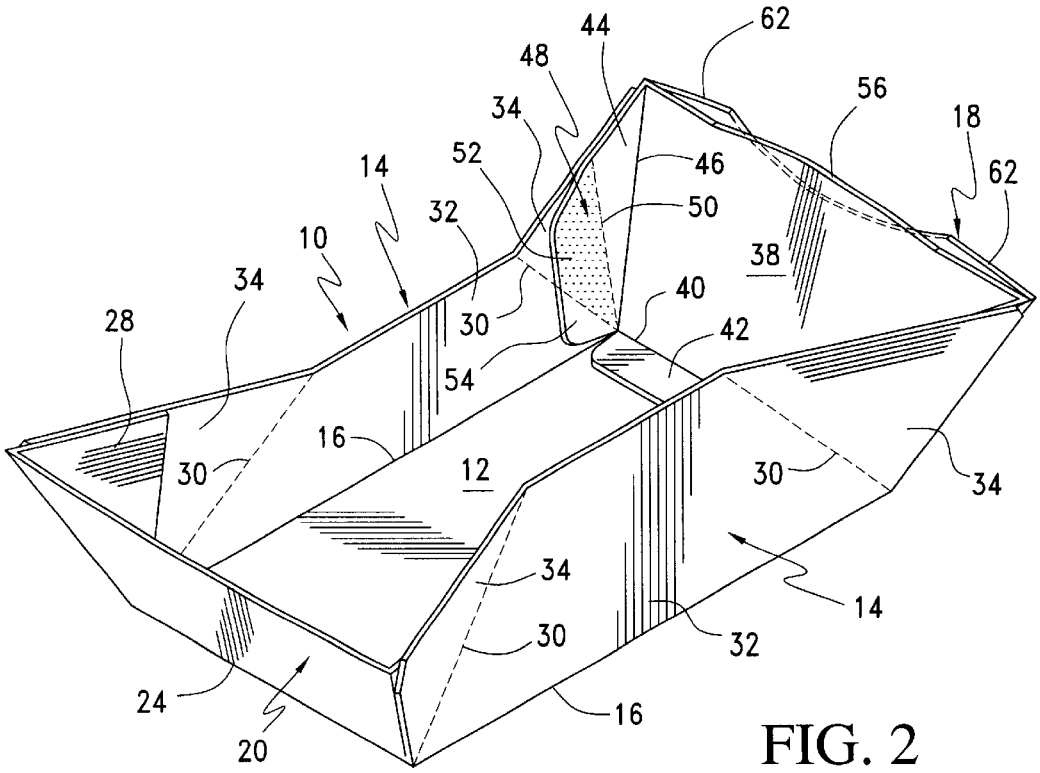
FIG. 2 is a top perspective of the open tray and prior to an opening of the condiment pocket.

The partition panel 38 in its collapsed position prior to an opening of the pocket 36, as noted in FIG. 2, directly overlies the end wall 18. The lower edge 40 of the partition panel 38 lies along the end edge 22 of the bottom 12 with this lower edge 40 being fixed to the bottom 12 by a laterally directed glue flap 42 integral with the lower edge 40 of the panel 38 and bonded to the adjacent portion of the bottom 12. The partition panel 38, so positioned, is foldable with the end wall 18 between the collapsed folded position of the tray and the open position thereof.

A pair of inverted triangular end panels 44 are integral with the opposed end edges of the partition panel 38 along fold lines 46. Each end panel 44 freely overlies the inner face of the corresponding side wall end section 34 with the fold line 46 extending upward from the corresponding corner of the bottom 12 and within the corner defined between the end wall 18 and the corresponding side wall 14.

Figure 4:
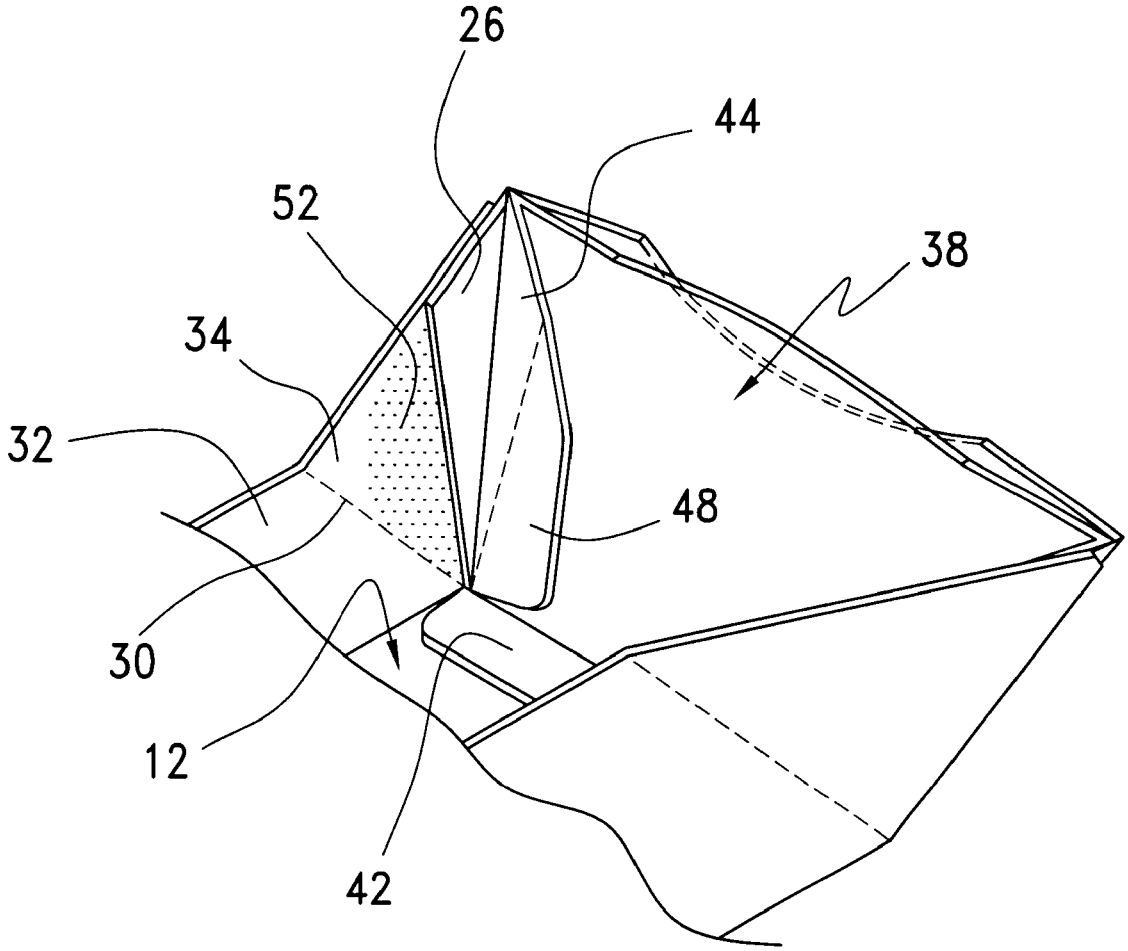
FIG. 4 is a perspective detail of the corner of the tray at one end of the partition panel with a portion of the end panel and glue flap folded back to more clearly illustrate the structural arrangement of the overlapped components.

Each end panel 44 in turn has a glue flap 48 integral with the end panel 44 along a fold line 50 extending upward from the corresponding corner of the bottom 12 and defining, with the fold line 46, the apex of the inverted triangular configuration of the end panel 44. The glue flap 48, coplanar with the end panel 44, overlies the inner face of the corresponding end section 34 of the adjacent side wall 14 and is bonded to this section 34. This bonded area is generally indicated at reference numeral 52 in FIGS. 2 and 4. As desired, each of the glue flaps 48 can depend below the diagonal fold line 30 which defines the corresponding side wall end section 34, as indicated at 54, to freely overlie that portion of the central section 32 of the side wall 14 immediately below the fold line 30 to provide additional stability in the opened tray as shall be described subsequently.

With the end panels 44 of the partition and the glue flaps 48 solely bonded, through the glue flaps 48, to the side wall end sections 34, each end panel 44 and companion glue flap 48 will fold with the corresponding side wall end section 34 in the manner previously described for the end section alone and as suggested in FIG. 2. Thus, the partition panel is effectively accommodated in the folded or collapsed position of the food tray.

Noting specifically FIG. 3, when it is desired to open the pocket 36 after an outward folding of the tray walls, one need merely engage the upper edge portion 56, suitably configured for easy access thereto, and move this upper edge inwardly relatively to the interior of the tray whereby the partition panel 38 is pivoted away from the end wall 18 about the lower edge 40 thereof. In doing so, the triangular end panels 44, foldably joined to the opposite ends of the partition panel 38, inwardly rotate 180° about fold lines 50, such folding being accommodated by fold lines 46 which define the end panels, to a position whereby the end panels 44 overlie the corresponding glue flaps 48 inward of the end wall 18. In this position, the partition panel 38 forcibly engages against the opposed side walls 14 generally at the adjacent side wall fold lines 30 to preclude any tendency for the opposed side walls 14 to inwardly fold. It will be noted that this engagement is principally with the corresponding side wall end sections 34, thus preventing an inward flexing of these end sections 34 toward each other as would be required for an inward movement of the side wall central sections 32 to the collapsed position thereof. With continued reference to FIG. 3, it will be noted that the lower sections 54 of the glue flaps 48 are also forcibly retained against the central section 32 of the side walls 14 by the partition panel 38 as a further rigidification of the opposed side walls against inward collapse toward each other.

As will be recognized, the combined width of the partition panel 38 and the two associated end panels 44 is greater than the width of the tray. As such, movement of the partition panel between the closed and open positions thereof, and the inverting or over center movement of the end panels 44, is accommodated by the inherent resilient flexible nature of the material. Further, the partition panel, in each of its positions, is physically fixed against accidental movement and requires a positive manual manipulation to move over center, particularly from its collapsed position of FIG. 2 to its open position of FIG. 3. Once in its open position of FIG. 3, the partition panel will remain open and provide a positive intermediate brace between the opposed side walls resulting in a rigid food tray, notwithstanding the collapsible nature thereof. There is thus achieved a tray with internal pocket which incorporates all of the desirable features of a folded carton, along with the rigidity and stability of a formed carton.

Figure 6:
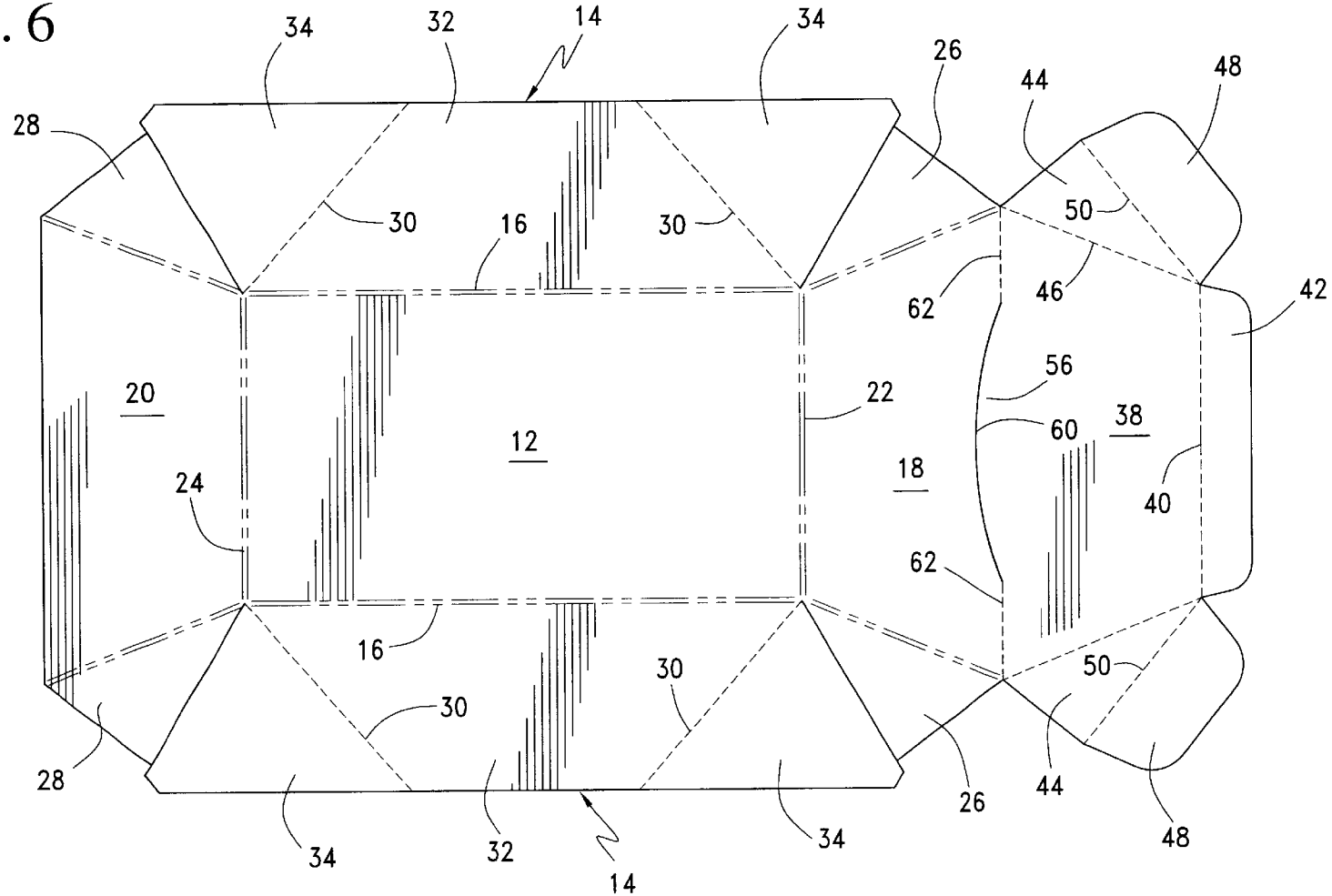
FIG. 6 is a plan view of the blank from which the tray is folded.

Referring now to FIG. 6, the unitary blank from which the tray of the invention is formed has been illustrated therein. All of the above described walls, panels, sections, and the like, of the tray have been designated by like reference numerals for ready comparison.

One feature of the invention best illustrated in the blank is the integral nature of the partition panel 38 which, in the blank, is longitudinally aligned with the end wall 18 along a parting line therebetween including a central arcuate segment 60 in the nature of a cut line which, upon a folding of the partition panel 38 over the end wall 18 provides the desired upward gripping area or lip 56 for the inward flipping of the partition panel. The parting line also includes, to the opposite ends of the central arcuate cut 60, longitudinally extending severance or readily separable parting lengths 62 which retain the partition panel 38 and adjoining end panel during the folding thereof. Such severance lines 62, if not parted before, will readily part upon an inward flipping of the partition panel from the position of FIG. 2 to the position of FIG. 3.

As will be noted, the blank, in order to avoid waste and maximize the use of material, is of a generally rectangular configuration with the end walls, bottom and partition panel longitudinally aligned and with the opposed side walls extending along the opposed edges of the bottom 12 and in turn aligning with the tray glue flaps 26 and 28 as well as the partition panel end panels 44 and associated glue flaps 48. The side walls 14, as previously described with regard to the tray itself, each include a pair of diagonal fold lines 30 which extend from the corresponding corners of the bottom 12 and divide each side wall 14 into three foldably related sections. Other than for these side walls, the remaining walls and panels, while interconnected by appropriate fold lines, are in themselves non-folding panels.

It is to be appreciated that in the above detailed description of the invention, the terms side wall and end wall have been used to facilitate illustration of the features of the invention. The tray can, as desired, be square with the four walls thereof equal. Further, the described pocket can equally be mounted relative to a longer side wall as opposed to a relatively shorter end wall. It should also be recognized that opposed pockets can similarly be provided on a pair of opposed walls, whether end walls or side walls. Basically, while preferred embodiments have been set forth, various modifications, changes and the like, as fall within the scope of the invention set forth in the claims following hereinafter are also contemplated.

What is claimed is:

1. A foldable food tray with an internal condiment pocket, said tray comprising a bottom having opposed end edges and opposed side edges extending between said end edges, a wall about said bottom, said wall including laterally spaced side walls integral with and inwardly foldable relative to said bottom along said side edges, an end wall integral with an inwardly foldable relative to said bottom along one of said end edges, said side and end walls being selectively movable between a first inwardly folded position in substantially parallel stacked position on said bottom and a second outwardly open position extending upward relative to said bottom to define an upwardly opening compartment, a partition panel within said compartment coextensive with said end wall immediately inward thereof, said partition panel having a lower edge foldably joined to said bottom immediately adjacent said end wall for folding movement with said end wall between said folded and open positions of said walls, said partition panel, in said open position of said walls, being inwardly foldable along said lower edge thereof relative to said end wall from a closed position overlying said end wall to an expanded position defining a pocket between said partition panel and said end wall within said tray compartment.

2. The foldable food tray of claim 1 wherein said partition panel, in said expanded position, extending between and engaging said side walls in inwardly spaced relation to said end wall and retaining said side walls against inward folding of said side walls to said inwardly folded position.

3. The foldable food tray of claim 2 including a second end wall integral with and inwardly foldable relative to a second one of said end edges, each of said side and end walls having opposed ends joining the ends of adjacent walls along fold lines defined therebetween whereby said wall is continuous about said bottom, said walls each folding relative to the adjacent walls about the joined ends thereof upon movement of said walls between said folded and open positions.

4. The foldable food tray of claim 3 wherein each side wall includes a pair of fold lines therein, each fold line extending diagonally from a corner defined at one end of the corresponding side wall at the corresponding side edge of the bottom across the wall to an outer edge thereof, the pair of fold lines in each side wall dividing each of these walls into a central section and a pair of end sections foldable relative to the central section to allow for an inward folding of each side wall on itself and over said bottom.

5. The foldable food tray of claim 4 wherein the central section of each divided side wall is of a generally trapezoidal configuration, and each of the end sections thereof is of a triangular configuration.

6. The foldable food tray of claim 5 wherein said partition panel includes opposed end edges, an end panel integral with each end edge and foldable relative thereto along a fold line defined along the end edge, and a glue flap extending from each end panel with a fold line between the glue flap and end panel for folding movement of the end panel relative to the glue flap, each end panel and extending glue flap overlying an adjacent triangular end section of an adjacent side wall, the glue flap being bonded to the end section for folding movement of the end panel and glue flap with said side wall end section, the end panel being free of the side wall end section for folding movement relative to said end section and glue flap.

7. The foldable food tray of claim 6 wherein each of said glue flaps including a portion thereof extending into free overlying relation to the central section of the corresponding side wall beyond the diagonal fold line defining the side wall end section to which the glue flap is bonded.

8. The foldable food tray of claim 7 wherein said end panels, in the closed position of the partition panel, engage and directly overlying the adjacent end sections of said side walls in a common plane with the associated glue flaps, said end panels in the expanded position of said partition panel being inverted out of the common planes of the associated glue flaps and engaging and directly overlying the glue flaps.

9. The foldable food tray of claim 8 wherein said partition panel and adjacent end wall have substantially coextensive upper edges, a portion of the upper edge of said partition panel extending above a corresponding portion of the upper edge of said end wall allowing access to said partition panel upper edge for inward pivotal movement of the partition panel relative to said end wall.

10. The foldable food tray of claim 9 wherein the combined length of said partition panel and end panels, between said side walls in the open position of the side walls, is greater than the distance between said side walls, requiring an over-center movement of said end panels as said partition panel moves between said closed and open positions thereof, whereby said partition panel is physically retained in each of said closed and open positions against inadvertent movement therefrom.

11. The foldable food tray of claim 8 wherein the combined length of said partition panel and end panels, between said side walls, is greater than the distance between said side walls, requiring an over-center movement of said end panels as said partition panel moves between said closed and open positions thereof for a physical retention of said partition panel in each of said closed and open positions against inadvertent movement therefrom.

12. The foldable food tray of claim 3 wherein each side wall includes fold lines therein extending transversely thereacross outward from said bottom and dividing each side wall into multiple sections allowing for an inward folding of each side wall with the sections in overlying relation to each other and to said bottom.

13. A foldable food tray with an internal condiment pocket, said tray comprising a bottom, an opposed pair of side walls foldably joined to said bottom, a first end wall foldably joined to said bottom and extending between said side walls, said end and side walls having adjacent ends and being foldably joined at the adjacent ends thereof, said side walls comprising foldable wall sections allowing for an inward folding of said side walls into overlying relation to each other and said bottom, said end wall being selectively foldable over into overlying relation to said inwardly folded side walls, a partition positioned immediately inward of said end wall and extending between said opposed side walls, said partition having opposed ends adjacent said side walls, and means mounting each partition end to the adjacent side wall for selective movement of the partition between a closed position overlying and engaging said end wall for folding therewith, and a second open position inwardly spaced from said end wall and in bracing engagement with said opposed side walls inward of said end wall to preclude folding of said side walls.

14. The foldable food tray of claim 13 wherein said partition includes a lower edge foldably joined to said bottom for pivotal movement of said partition between said closed and open positions thereof.

15. A unitary blank of foldable sheet material comprising a bottom panel, a pair of end wall panels longitudinally aligned with said bottom panel with fold lines defined therebetween, a partition panel joined to one end wall panel and extending longitudinally therebeyond, a parting line between said partition panel and said one end wall panel, a pair of side wall panels transversely of and to opposite sides of said bottom panel and extending longitudinally along the length thereof, fold lines defined between said bottom panel and said side wall panels, fold lines extending diagonally transversely across each side wall panel dividing the side wall panel into a generally trapezoidal central section and two generally triangular end sections, said partition panel having opposed longitudinally directed edges, each with an end panel integral therewith with a fold line defined therebetween, and a glue flap integral with each end panel with a fold line defined between the glue flap and the end panel.

16. The unitary blank of claim 15 wherein the parting line defined between said partition panel and the adjacent end wall panel includes a central section wherein the panels are completely severed from each other and two end lengths wherein the partition panel and adjacent end wall panel are foldably joined and readily separable upon lateral movement of the partition panel away from the adjacent end wall panel.

* * * * *